US005932531A

United States Patent [19]

Oberlander et al.

[11] Patent Number: 5,932,531

[45] Date of Patent: Aug. 3, 1999

[54] METHOD FOR FORMING SOLID DETERGENT ACTIVATOR FOR USE WITH OXYGEN BLEACHES

[75] Inventors: Michael Oberlander, Kansas City; Robert P. Langguth, Overland, both of Mo.

[73] Assignee: Noramtech Corporation, Kansas City, Mo.

[21] Appl. No.: 08/938,759

[22] Filed: Sep. 26, 1997

[51] Int. Cl.[6] ..... C11D 3/04; C11D 3/06; C11D 3/395

[52] U.S. Cl. ..... 510/312; 510/318; 510/376; 510/444; 510/445; 510/446; 510/447; 510/499

[58] Field of Search ..... 510/312, 318, 510/376, 444, 445, 446, 447, 499

[56] References Cited

U.S. PATENT DOCUMENTS

| | | | |
|---|---|---|---|
| Re. 32,818 | 1/1989 | Fernholz et al. | 252/90 |
| 4,422,950 | 12/1983 | Kemper et al. | 252/186.38 |
| 5,021,182 | 6/1991 | Jentsch | 252/102 |
| 5,236,615 | 8/1993 | Trinh et al. | 252/174.11 |
| 5,489,434 | 2/1996 | Oakes et al. | 424/405 |
| 5,616,550 | 4/1997 | Kruse et al. | 510/444 |
| 5,705,464 | 1/1998 | Scheper et al. | 510/221 |
| 5,780,404 | 7/1998 | Bacon et al. | 510/101 |
| 5,783,540 | 7/1998 | Secemski et al. | 510/224 |

*Primary Examiner*—Yogendra Gupta
*Assistant Examiner*—Gregory R. Delcotto
*Attorney, Agent, or Firm*—Hovey, Williams, Timmons & Collins

[57] ABSTRACT

Solid activator bodies for activating oxygen-based bleach at relatively low temperatures are provided which preferably include respective quantities of tetra acetyl ethylene diamine (TAED), phosphate sequestering agent, non-phosphate solidifying agent, surfactant and water. The activator bodies are readily dispersable in hot water to form dilute dispersions which can be added directly to cleaning equipment along with oxygen-based bleach. The activator enhances bleaching effectiveness and generates peracetic acid, a potential antimicrobial.

10 Claims, 1 Drawing Sheet

METHOD FOR FORMING SOLID DETERGENT ACTIVATOR FOR USE WITH OXYGEN BLEACHES

BACKGROUND OF THE INVENTION

1. Field of the Invention

This present invention relates to solid bleach activator compositions and methods for use and preparation thereof More particularly, the invention pertains to activator compositions that include tetra acetyl ethylene diamine (TAED) and a phosphate salt capable of forming peracetic acid with the hydrogen peroxide component of bleach. Preferably, solid activator and bleach-containing bodies are diluted in separate containers before simultaneous addition to a detergent solution. The solid activator composition may be used in detergent/bleaching agent systems for warewashing, laundry, or general hard surface cleaning.

2. Description of the Prior Art

Oxygen-based bleaching agents have been widely used as an adjunct to detergents for household and industrial dishwashing, laundering, and general hard surface cleaning applications, because of the improved cleaning results that are directly attributable to the bleaching composition. However, in order for the oxygen-based bleaching composition to be effective, it is necessary that the washing temperature be greater than 140° F. At lower temperatures, oxygen-based bleaches, such as the perborates and percarbonates, are in-effective.

It has been well documented that tetra acetyl ethylene diamine (TAED) activates the peroxide carriers of oxygen-based bleaches and provides effective bleaching of stains at temperatures below 140° F. for which the oxygen-based bleaches alone are ineffective. Furthermore, it has been documented that TAED-activated formulations kill bacteria and other microorganisms even at these lower temperatures. However, prior TAED formulations have been in liquid form and are consequently difficult to use with many types of dishwashing and other equipment which typically employ solid cleansing products.

There is accordingly a need in the art, particularly in the industrial laundering area, for substantially homogeneous solid oxygen bleach activator-containing compositions which will readily dissolve in warm or hot water, and provide activation for oxygen-based bleaches at temperatures below 140° F. Furthermore, the solid activator composition should improve the bleaching of stains and demonstrate a significant antimicrobial effect.

SUMMARY OF THE INVENTION

The present invention overcomes the problems outlined above, and provides a solid bleach activator comprising a solid, self-sustaining, monolithic body having therein respective quantities of tetra acetyl ethylene diamine, phosphate sequestering agent and non-phosphate solidifying agent, such ingredients being intimately mixed and formed into a solid body. Preferably, the activator bodies include from about 2–20% by weight tetra acetyl ethylene diamine, from about 20–60% by weight phosphate sequestering agent, from about 2–25% by weight non-phosphate solidifying agent, and from about 10–50% by weight water. The activator compositions of the invention are also normally formulated with effective levels of organic surfactant and other functional ingredients. The solid activator compositions typically have a specific gravity of from about 0.8 to 1.7, and more preferably from about 1.0 to 1.4. Likewise, such solid bodies normally have a hardness such that they melt at temperatures greater than 130° F. In use, the solid activators are subjected to hot water under pressure so as to produce an aqueous activator dispersion which can be combined with a dilute aqueous oxygen-based bleach in a detergent system so as to activate the bleach even at relatively low temperatures.

The solid activator bodies of the invention are advantageously used in conjunction with a solid self-sustaining monolithic body containing a quantity of peroxyhydrate salt bleach. The bleach-containing and activator bodies are then subjected to corresponding quantities of hot water (usually from about 110°–140° F.) for dispersion thereof, thereby producing a bleaching dispersion and an activator dispersion. Such dispersions are then introduced, either simultaneously or seriatim, into the cleaning chamber of equipment such as an industrial dishwasher along with a liquid washing and/or cleaning dispersion. Normally, equipment of this type includes first and second bowls equipped with spray heads; the bleach-containing and activator bodies are placed within a respective bowl and are subjected to hot, pressurized water for creation of the corresponding dispersions. Such dispersions are then introduced via conduits leading to the equipment cleaning chamber.

DETAILED DESCRIPTION OF THE PREFERRED EMBODIMENTS

Figure 1:
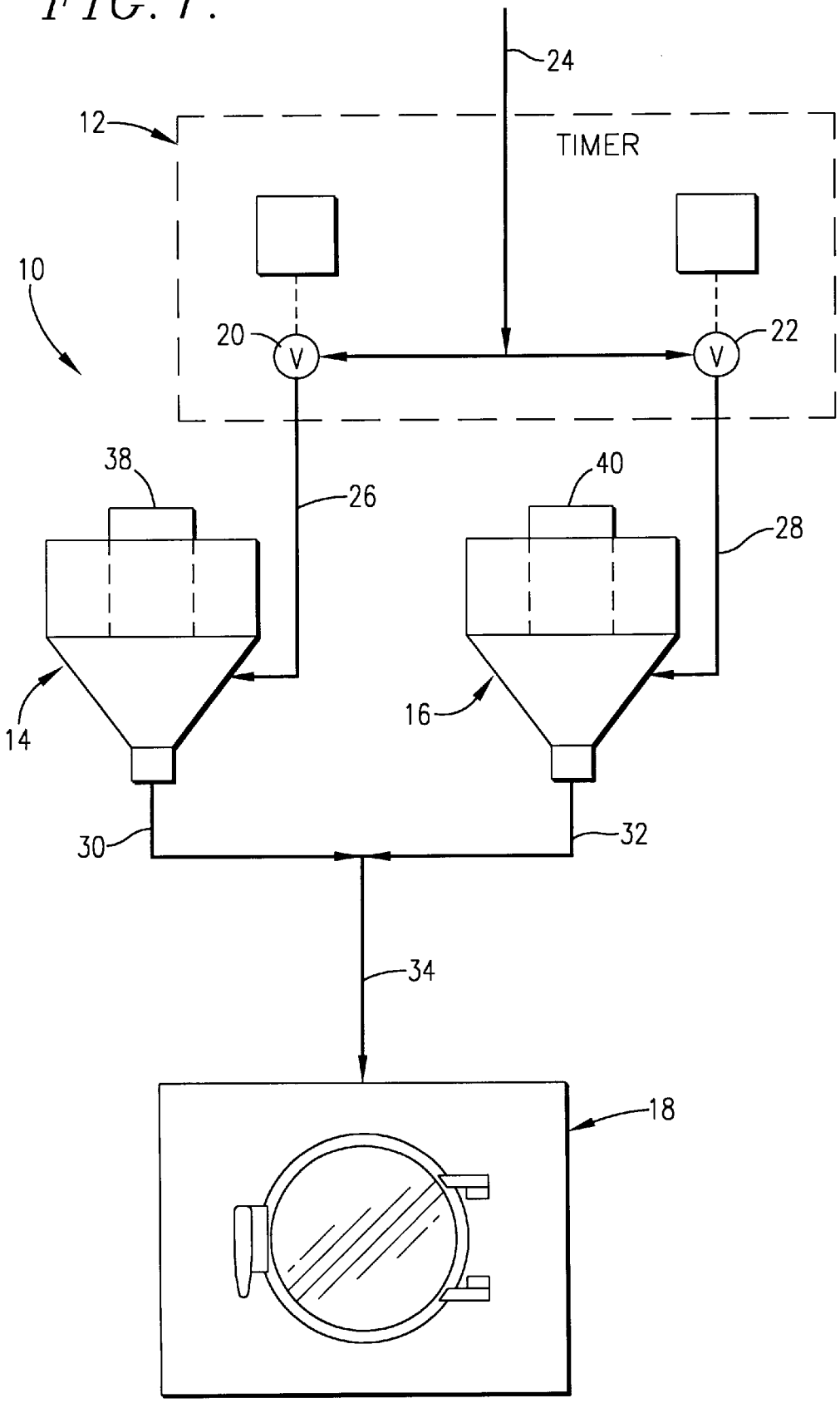
FIG. 1 is a schematic representation of the preferred washing and/or cleaning equipment designed to use the solid activator bodies of the present invention.

In preparing the solid activator bodies of the invention, a quantity of tetra acetyl ethylene diamine (TAED) is first mixed with an amount of water. Desirably, TAED comprises from about 2–20% by weight of the final solid body while water makes up from about 10–50% by weight thereof. This initial formulation is then combined with a sequestering agent such as one or more phosphate salts in amounts of from about 20–60% by weight of the solid body, together with from about 2–25% by weight of non-phosphate solidifying agent. Other optional ingredients such as organic surfactants, dispersing agents, and fluorescent whitening agents may be added. The resultant slurry is then poured into a suitable mold for cooling into a solid body.

The preferred phosphate sequestering agent or salt fraction is a mixture of from about 25–75% by weight of tetrasodium pyrophosphate (more preferably from about 40–60% by weight) and from about 75–25% by weight of pentasodium tripolyphosphate (more preferably from about 65–35% by weight), based upon the total weight of the sequestering agent salt fraction taken at 100% by weight. Sodium hexametaphosphate may be used in place of a portion of the tetrasodium pyrophosphate in amounts up to 10% by weight, based upon the total weight of the sequestering agent. In addition, tetrapotassium pyrophosphate may be substituted for tetrasodium pyrophosphate for faster water solubility in amounts of from about 12.5–37.5% by weight of the sequestering agent salt fraction. While the primary function of the phosphates is to serve as a hard water ion sequesterant to facilitate dispersion of the activator bodies in water, the phosphates also simultaneously may serve as water-absorbing solidifying agents.

A wide variety of non-phosphate solidifying agents can be used in the solid compositions of the invention. The most commonly employed solidifiers are sodium sulfate or sodium chloride and mixtures thereof. The non-phosphate solidifying agent is preferably used at a level of from about 4–20% by weight.

When the solid activator composition is designed to be used with a warewashing or laundry detergent, it is preferably formulated to contain effective amounts of synthetic organic surfactants. The surfactants should be chosen so as to be stable and chemically compatible in the presence of hydrogen peroxide. One class of useful surfactants are the anionic surfactants. Preferred anionic surfactants include alkali metal alkylbenzene sulfonates, alkali metal alkyl ether sulfates, alkali metal alkyl sulfates, alkali metal alpha olefin sulfonates, alkali alkane sulfonates, and mixtures thereof.

Nonionic surfactants may be employed either alone or in combination with the anionic surfactants. This class of synthetic detergents may be broadly defined as compounds produced by the condensation of alkylene oxide groups with an organic hydrophobic compound that may be aliphatic or aromatic in nature. Preferred nonionic surfactants include polyethylene oxide condensates of alkylphenols, polyethylene oxide condensates of primary or secondary alcohols, polyoxyethylene condensates of a hydrophobic polypropyleneoxide/propylene glycol condensate, alkyl polyglucosides, and alkyl amine oxides.

The amount of organic surfactants added to the activator composition varies depending on the intended use of the composition. For example, an effective activator composition can be prepared containing from about 0.5–15% by weight of the surfactant agent.

Dispersing agents, such as sodium polyacrylates, citric acid, ethylenediaminetetraacetic acid (EDTA) or nitrilotriacetic acid (NTA), can also be added to the activator composition. The preferred dispersing agent is sodium polyacrylate because of its effectiveness in the presence of phosphate salts. Furthermore, fluorescent whitening agents can be added so long as they are compatible with oxygen-based bleaches.

A preferred activator composition is prepared as follows, using the ingredients of Table 1.

TABLE 1

| Constituent | % by weight |
|---|---|
| Water | 30.0 |
| Sodium polyacrylate (Colloid 207, 45–50%) | 5.0 |
| Tetra acetyl ethylene diamine (TAED) | 8.0 |
| Tetrasodium pyrophosphate | 18.0 |
| Sodium sulfate | 11.8 |
| Sodium alkylbenzene sulfonate (90%) | 3.0 |
| Tinopal CBS (Fluorescent whitening agent) | 0.2 |
| Pentasodium tripolyphosphate | 22.0 |
| Polyglucoside 625 FE nonionic surfactant | 2.0 |

In preparing a solid activator body using the above ingredients, 150 grams of tap water was placed in a mixer and agitation was commenced. Then 25 grams of Colloid 207 was added, followed by 40 grams of TAED. When these ingredients were evenly dispersed in the mixer, 90 grams of tetrasodium pyrophosphate and 59 grams of sodium sulfate were added and agitation was continued until dissolution was nearly complete. Then 15 grams of the sodium alkylbenzene sulfonate and 1 gram Tinopal CBS were added with continued agitation. One hundred ten grams of pentasodium tripolyphosphate were next added, and as soon as an even dispersion was attained 10 grams of the Polyglucoside 625 FE nonionic surfactant were added. When the completed slurry showed signs of a viscosity increase upon further mixing, the slurry was poured into capsules and allowed to cool and harden for 24 hours. At this point the solid activator body was ready for use. In one commercial embodiment, the finished activator body weighs approximately 7 pounds.

When the activators of the invention are used in combination with oxygen-based bleach in detergent systems, peracetic acid is formed in situ in the cleaning or laundry equipment. Peracetic acid is a very powerful antimicrobial, and therefore the activators hereof can be used, e.g., to control potential avenues of infection through the wash water effluent from laundries in hospitals and nursing homes. In one comparative test, the bacteriological contamination of laundry wash water from the garments of incontinent nursing home patients was measured. Use of the activators of the invention reduced the total bacterial colony counts by around 99.9%, while the gram negative organisms were totally eliminated.

The solid activator bodies are stable during storage at ambient temperatures, and surface portions thereof rapidly disperse in water when introduced into standard washing equipment. Preferably, the solid activator bodies are subjected to hot, pressurized water so as to create a dispersion containing from about 0.1–10% by weight activator composition in water, and more preferably from about 0.5–5% by weight thereof. Such dilute dispersions generally contain from about 0.002–2% by weight TAED, and more preferably from about 0.015–0.75% be weight TAED.

FIG. 1 illustrates washing and/or cleaning equipment 10 in accordance with the present invention. Equipment 10 includes timer assembly 12, first spray-equipped bowl 14, second spray-equipped bowl 16, and washing machine 18. Timer assembly 12 has first solenoid valve 20, second solenoid valve 22, and main branched water pipe 24 connected to valves 20 and 22. Water lines 26, 28 respectively extend from valves 20, 22 first and second bowls 14, 16. Conventional piping 30–34 interconnects the outlets of bowls 14, 16 with washing machine 18.

As illustrated, first bowl 14 contains first body 38 including the preferred bleaching composition. Similarly, second bowl 16 contains second activator body 40.

In operation, timer 12 selectively activates first and second solenoid valves 20, 22 on a pre-determined timed basis. Upon activation, the valves 20, 22 open to supply water from water pipe 24 (connected to a water supply) to first bowl 14 by way of line 26 and to second bowl 16 via line 28. Upon receipt of water in the bowls 14,16, bodies 38, 40 begin to dissolve. The effluent from first bowl 14 containing dissolved bleaching composition flows via piping 30, 34 into washing machine 18; similarly, the underflow from bowl 16 passes through piping 32, 34 to machine 18. In particular, the dispersed bleaching and activator compositions are introduced into a conventional washing and/or cleaning solution within the washing chamber of machine 18. In the preferred embodiment, timer 12 opens solenoid valves 20, 22 long enough so that surface portions of bodies 38,40 dissolve to the desired extent, yielding bleach and activator dispersions of appropriate concentration for delivery to machine 18. The introduction of the bleach and activator dispersions can be simultaneous or seriatim.

The following table sets forth approximate broad, preferred and most preferred ranges for the essential and optional ingredients of the solid activator compositions of the invention, where all ranges are given on the basis of percent by weight of the total activator body composition.

TABLE 2

| Ingredient | Broad Range (% by wt.) | Preferred Range (% by wt.) | Most Preferred Range (% by wt.) |
|---|---|---|---|
| Tetra acetyl ethylene diamine | 2–20 | 3–15 | 6–12 |
| Phosphate sequestering agent | 20–60 | 25–50 | 35–45 |
| Surfactant | 0.5–15 | 2–10 | 3–7 |
| Non-phosphate solidifying agent | 2–25 | 4–20 | 8–15 |
| Dispersing agent | 0.5–10 | 2–8 | 3–7 |
| Water | 10–50 | 20–40 | 25–35 |

We claim:

1. An activator composition for a peroxyhydrate salt bleaching composition comprising:

(a) from about 2–20% by weight of tetra acetyl ethylene diamine (TAED);

(b) from about 20–60% by weight of phosphate sequestering agent for the TAED;

(c) from about 2–25% by weight of a non-phosphate solidifying agent; and (d) from about 10–50% by weight water, said TAED, sequestering agent, water and solidifyng agent being intimately admixed and formed into a solid, self-sustaining, monolithic body by said water reacting with phosphates from said sequestering agent to form hydrates, said solid body capable of being dissolved in water in a relatively short period of time.

2. The activator as set forth in claim 1, wherein said sequestering agent is selected from the group consisting of alkali metal pyrophosphates, alkali metal tripolyphosphates, and alkali metal hexametaphosphates.

3. The activator as set forth in claim 2, wherein said alkali metal pyrophosphate is selected from the group consisting of sodium pyrophosphates, potassium pyrophosphates, and mixtures thereof.

4. The activator as set forth in claim 1, wherein said non-phosphate solidifying agent is selected from the group consisting of sodium sulfate, sodium chloride, and mixtures thereof.

5. The activator as set forth in claim 1, wherein said activator includes a surfactant.

6. The activator as set forth in claim 5, wherein said surfactant is present at a level of from about 0.5–15% by weight.

7. The activator as set forth in claim 6, wherein said surfactant is selected from the group consisting of alkali metal alkylbenzene sulfonates, alkali metal alkyl ether sulfates, alkali metal alkyl sulfates, alkali metal alpha olefin sulfonates, alka polyethylene oxide condensates of alkylphenols, polyoxyethylene condensates of a hydrophobic polypropylenoxide/propylene glycol condensation, alkyl polyglucosides, alkyl amine oxides, and mixtures thereof.

8. The activator as set forth in claim 1, wherein said activator includes a dispersing agent.

9. The activator as set forth in claim 8, wherein said dispersing agent is selected from a group consisting of sodium polyacrylates, citric acid, EDTA, NTA, and mixtures thereof.

10. A solid bleach activator comprising a solid, self-sustaining, monolithic body having therein from about 2–20% by weight tetra acetyl ethylene diamine, from about 20–60% by weight phosphate sequestering agent, from about 2–25% by weight non-phosphate solidifying agent and from about 10–50% by weight water said water being reacted with phosphates from said sequestering agent to form hydrates.

* * * * *